US009003605B2

(12) United States Patent
Pecar et al.

(10) Patent No.: US 9,003,605 B2
(45) Date of Patent: Apr. 14, 2015

(54) FURNITURE HINGE WITH INCORPORATED WING HAVING LINEAR AND ROTARY MOVEMENT

(75) Inventors: David Pecar, Koper (SI); Valter Svara, Izola (SI)

(73) Assignee: Lama D.D. Dekani, Dekani (SI)

( * ) Notice: Subject to any disclaimer, the term of this patent is extended or adjusted under 35 U.S.C. 154(b) by 160 days.

(21) Appl. No.: 12/450,989

(22) PCT Filed: May 6, 2008

(86) PCT No.: PCT/SI2008/000029

§ 371 (c)(1),
(2), (4) Date: Feb. 5, 2010

(87) PCT Pub. No.: WO2008/136780

PCT Pub. Date: Nov. 13, 2008

(65) Prior Publication Data

US 2010/0139041 A1 Jun. 10, 2010

(30) Foreign Application Priority Data

May 8, 2007 (SI) ..... 200700110

(51) Int. Cl.
*E05F 5/00* (2006.01)

(52) U.S. Cl.
CPC ..... *E05F 5/006* (2013.01); *E05Y 2201/10* (2013.01); *E05Y 2201/21* (2013.01); *E05Y 2201/256* (2013.01); *E05Y 2201/264* (2013.01); *E05Y 2201/604* (2013.01); *E05Y 2201/622* (2013.01); *E05Y 2600/46* (2013.01); *E05Y 2900/20* (2013.01)

(58) Field of Classification Search
CPC ..... E05F 5/006
USPC ..... 16/296, 277, 280, 251, 366, 368, 371, 16/286–289, 294, 54, 56, 370, 354, 50
See application file for complete search history.

(56) References Cited

U.S. PATENT DOCUMENTS

| | | | | |
|---|---|---|---|---|
| 3,975,791 | A * | 8/1976 | Hettich et al. | 16/294 |
| 6,230,365 | B1 * | 5/2001 | Lu | 16/342 |
| 6,289,556 | B1 * | 9/2001 | Salice | 16/335 |
| 7,552,509 | B2 * | 6/2009 | Chen et al. | 16/50 |
| 7,669,285 | B2 * | 3/2010 | Gallasch et al. | 16/286 |
| 7,748,082 | B2 * | 7/2010 | Harald et al. | 16/286 |
| 8,640,305 | B2 * | 2/2014 | Pecar et al. | 16/50 |
| 2004/0107540 | A1 * | 6/2004 | Hsu | 16/366 |
| 2004/0205935 | A1 * | 10/2004 | Lautenschlaeger et al. | 16/374 |
| 2006/0200944 | A1 * | 9/2006 | Salice | 16/286 |
| 2008/0209674 | A1 * | 9/2008 | Harald et al. | 16/82 |

(Continued)

FOREIGN PATENT DOCUMENTS

| | | |
|---|---|---|
| SI | 21971 | 8/2006 |
| SI | 22097 | 2/2007 |
| WO | 2006088435 | 8/2006 |

(Continued)

*Primary Examiner* — Emily Morgan
(74) *Attorney, Agent, or Firm* — Jacobson Holman, PLLC.

(57) ABSTRACT

A furniture hinge including a toggle-type hinge and a line shock absorber arranged transversely to a major axis of the toggle-type hinge. The line shock absorber is inserted into a holder and the holder is attached to the toggle-type hinge. The holder includes a bearing part and a position part, which are fixed to each other by at least one coupling element in the form of an unreleasable connection or a releasable one.

5 Claims, 2 Drawing Sheets

(56) References Cited

U.S. PATENT DOCUMENTS

| | | | | |
|---|---|---|---|---|
| 2009/0119876 | A1 * | 5/2009 | Pecar et al. | 16/293 |
| 2012/0036678 | A1 * | 2/2012 | Pecar et al. | 16/250 |

FOREIGN PATENT DOCUMENTS

| | | | | |
|---|---|---|---|---|
| WO | WO 2006088435 | A2 * | 8/2006 | E05D 3/06 |
| WO | WO 2007038815 | A1 * | 4/2007 | |

* cited by examiner

FURNITURE HINGE WITH INCORPORATED WING HAVING LINEAR AND ROTARY MOVEMENT

This is a national stage of PCT/SI08/000,029 filed May 6, 2008 and published in English, which has a priority of Slovenia no. P-200700110 filed May 8, 2007, hereby incorporated by reference.

OBJECT OF THE INVENTION

The object of the present invention relates to a furniture hinge with equipment comprising a toggle-type hinge and a line shock absorber arranged transversely to the major axis of the toggle-type hinge and attached to the toggle-type hinge by a holder.

Technical Problem

The technical problem to be solved by the invention is to eliminate or to reduce the unevenness of the friction appearing at the operation of the furniture hinge with equipment.

PRIOR ART

From Slovenian patents SI21971 and SI22097 of the same inventor, there is known a furniture hinge with equipment comprising a toggle-type hinge and a line shock absorber arranged transversely to a major axis of the toggle-type hinge. The line shock absorber is attached to a hinge pot of the toggle-type hinge by a holder. The holder of the line shock absorber is composed of a bearing, a semi-bearing and a spacer bar between them, with said members all fitted to the mantle diameter of the line shock absorber or to a wing sleeve comprising the line shock absorber. The assembly of the line shock absorber and the wing sleeve is held in the holder at one end by means of a semi-bearing and at the other end by a special control support. The holder is attached to the hinge pot by fixing elements.

The semi-bearing covers a free end of a shock absorber piston rod and serves as an axis support during the spiral movement of the wing sleeve from the bearing to the semi-bearing. At the operation of the device i.e. at closing a furniture element, the wing of the sleeve hits a hinge arm, slides against it and swings around its own rotation axis. The pushing force, with which the hinge closes the furniture element in a direction perpendicular to the line shock absorber, acts onto the wing and, over a motion-locking interconnection of a rib and a groove on the wing and the spacer piece, transmits itself to the sleeve. Because of the latter, the sleeve spirally moves in its longitudinal direction. The wing sleeve abuts on an upper mantle surface of the bearing and the semi-bearing. This causes a sliding friction, which reduces the effect of damping and increases the required closing force of the hinge. An adequate closing force can be determined at a constant friction, which, however, is not possible in the case described. Either bearing of the wing sleeve is assembled from two parts, which makes it impossible to ensure that said parts are coaxial. Since said bearings are not coaxial at the action of the transversal closing force, the wing sleeve moves out of its axial position and jams during the spiral movement, which causes uneven, momentarily very high friction forces. Since these friction forces are uneven, the required closing force of the toggle-type hinge cannot be determined, which can result in a less efficient damping or even in no damping at all. The furniture element has to be closed by a stroke or it is not closed completely.

Solution to the Technical Problem

The described technical problem is solved by a furniture hinge with equipment comprising a toggle-type hinge and a line shock absorber arranged transversely to a major axis of the toggle-type hinge and attached to the toggle-type hinge by a holder, whose essential characteristic is that the holder of the line shock absorber consists of two parts, a bearing part and a position part. The bearing part comprises two coaxial semi-bearings spaced apart by an integrated spacer piece and side-closed at the respective distal ends. A flange for an arrangement onto the toggle-type hinge pot is integrally formed to either semi-bearing. The position part has a bearing containing a spiral groove for forming a motion-locking interconnection with a rib to be found on the wing sleeve for the reception of the wing sleeve including the line shock absorber and two supporting webs integrated to the bearing. Each web has a nose at its free end. This nose determines the arrangement on the bearing part. The width of the bearing coincides with the width of the spacer piece of the bearing part.

When the line shock absorber, which, according to the embodiment, is inserted into the wing sleeve, is inserted into the bearing part of the holder, it is held in it with the position part. The latter is connected with the bearing part by fixing elements arranged on the bearing part as well as on the position part.

In an unloaded state of the device, the wing sleeve with its middle part abuts on the bearing of the position part, while both ends of the sleeve including the shock absorber piston rod are freestanding.

In the operation state of the device when closing the furniture element, a closing force acts onto the wing of the sleeve. Because of the motion-locking interconnection of a groove and a rib between the wing sleeve and the bearing of the position part, the action of the closing force results in a spiral movement of the wing sleeve inside the bearing part. Owing to the transverse closing force, the wing sleeve simultaneously abuts on a wall section of the bearing part, which causes a friction between the sleeve surface and the inside surfaces of both semi-bearings. Since both semi-bearings forming the bearing part are produced simultaneously within the same operation, this ensures that they are mutually coaxial. This also provides an even sliding of the wing sleeve inside the bearing part i.e. the semi-bearings. Since the wing sleeve only abuts on the semi-bearings while it moves, the sliding surface as well as the friction force are reduced.

Due to its design, the bearing part of the holder is preferably made of sheet metal of a suitable quality during a deep drawing operation, but also the method of pressure casting employed so far can be used. The position part of the holder is preferably manufactured by the method of pressure casting. Since the holder of the present invention can be produced of sheet metal, also the problem of blown casting surface, which often appears at pressure casting, is solved. In the case of a blown casting surface the casting needs to be machined to provide appropriate surface smoothness. This additional operation is undesired due to reasons of time and especially of economy.

BRIEF DESCRIPTION OF THE DRAWINGS

The present invention will now be described in more detail on the basis of an embodiment and of the accompanying drawings in which.

DETAILED DESCRIPTION OF THE PREFERRED EMBODIMENTS

Figure 1:
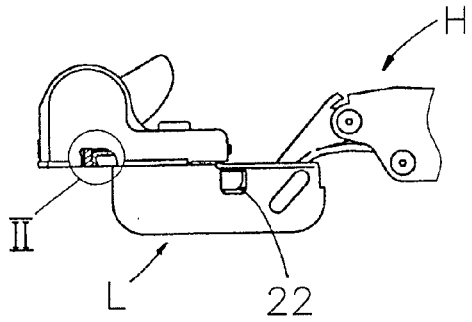
FIG. 1 shows a furniture hinge with equipment.
Figure 2:
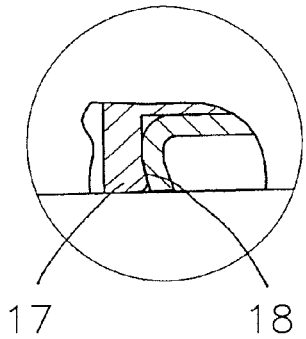
FIG. 2 shows the cross-section II of the hinge shown in FIG. 1.
Figure 3:
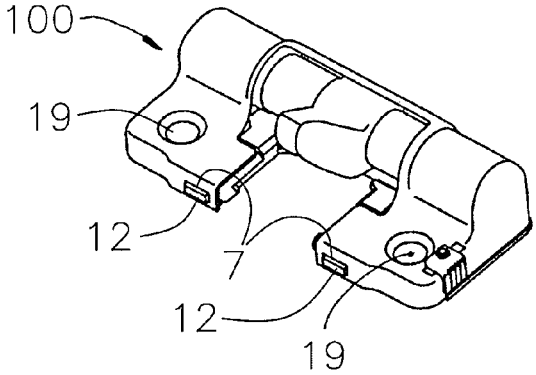
FIG. 3 shows a holder with a spiral connection for an attachment onto the pot of the toggle-type hinge.
Figure 4:
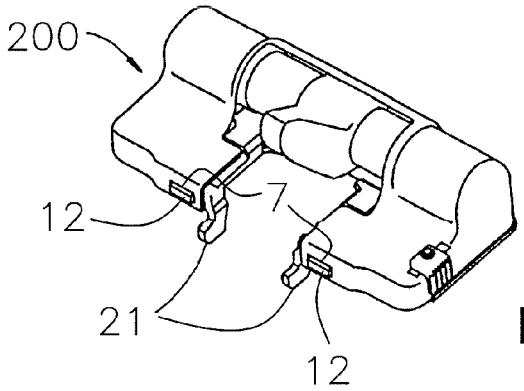
FIG. 4 shows the holder with a positive-locking connection to be attached to the pot of the toggle-type hinge.
Figure 5:
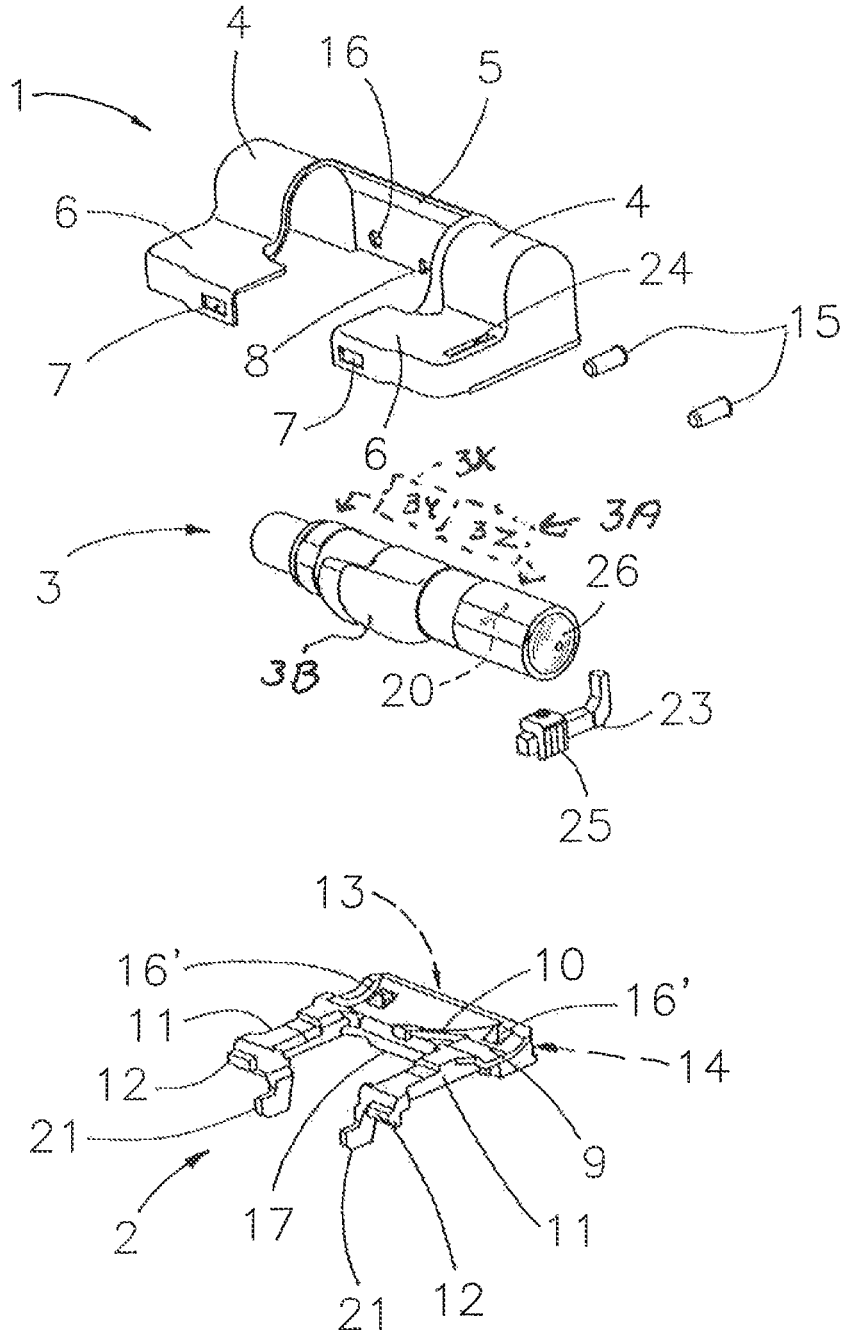
FIG. 5 shows the holder with a line shock absorber in an explosion drawing.

The furniture hinge with equipment comprises a toggle-type hinge H and a line shock absorber 3A shown schematically and arranged transversely to a major axis of the toggle-type hinge. The line shock absorber 3A consisting of a housing 3X, a piston rod 3Y and a pressure spring 3Z is actuated by means of a wing 3B. The wing 3B can be executed directly on the housing of the shock absorber or, as in the present embodiment, as an independent part in the form of a wing sleeve 3 into which the line shock absorber is inserted. The wing sleeve 3 including the line shock absorber 3A is inserted into a holder 100, 200 and, with the latter, attached to a toggle-type hinge pot.

The holder 100, 200 consists of two parts, a bearing part 1 and a position part 2.

The bearing part 1 comprises two coaxial semi-bearings 4 spaced apart by an integrally formed spacer piece 5 and side-closed at the respective distal ends. A flange 6 adapted to a flange of the toggle-type hinge pot is integrally formed to the respective semi-bearing 4.

The position part 2 consists of a bearing 9 for the reception of the wing sleeve 3 and of two supporting webs 11 integrally formed to the bearing. Either web 11 has a nose 12 at its free end for an engagement with a respective recess 7 on the flange 6 of the bearing part 1. The bearing 9 comprises a spiral groove 10 for the reception and guiding of a spiral rib 20 or of any other motion-locking element situated on the wing sleeve 3.

On a longitudinal edge 14 of the bearing 9, which is distant from the webs 11, there is placed a position tooth 13 (not shown) engaging with a cut-out 8 on the spacer piece 5 of the bearing part 1 at mounting. The pairs the nose 12/the recess 7 and the position tooth 13/the cut-out 8 determine the position of the position part 2 in the bearing part 1 at mounting. The bearing part 1 and the position part 2 are fixed to each other by at least one coupling element in the form of an unreleasable connection, e.g. by rivets 15 matching with holes 16, 16' on the spacer piece 5 or on the bearing 9, or of a releasable connection, e.g. by snap teeth (not shown) situated on the longitudinal distal edge 14 of the bearing 9 of the position part 2.

A bar 23 defines the position of the shock absorber and the wing sleeve in the holder 100, 200, which position determines the beginning of shock absorption. The bar 23 is with one end attached to a slider 25 through a recess 24 on the flange 6. The other, free end of the bar 23 abuts on an end 26 of the wing sleeve 3, which end is conically formed just for this purpose. In the null position of the device, a movement of the slider 25 and also of the bar 23 causes an axial movement of the wing sleeve 3. The latter spirally rotates because of the connection of the groove and of the rib, whereby the wing rotates as well. The result is a delay of the damping function.

The holder 100 has the flange 6 having holes 19 for an attachment onto the toggle-type hinge pot L, which holes coincide with holes (not shown) in the flange of the hinge pot L for (not shown) screws.

The holder 200 is attached to the toggle-type hinge pot L by means of teeth 21. The tooth 21 is formed as a projection which is integrated into the respective supporting web 11 of the position part 2. The tooth 21 forms a positive-locking connection with a respective opening 22 in the wall portion of the cavity of the hinge pot L pot from inside to outside in the direction of the major axis of the hinge.

The holder 200 is additionally positive-lockingly connected to the toggle-type hinge pot L. For this purpose, at least one tooth 17 is foreseen on the longitudinal edge of the bearing 9 nearer to the webs 11, which tooth 17 fits tightly into a foreseen impression 18 on the flange edge of the hinge pot L.

It is understandable that the holder can include all elements of attachment onto the hinge pot and that the way of attachment depends on the final mounting of the hinge onto the furniture element.

Because of the construction of the bearing part 1 of the holder according to the invention, it is possible to manufacture it, instead of using the usual method of pressure casting, by a forming method like deep drawing, out of sheet metal of a corresponding depth and mechanical properties. The position part 2 is produced by the method of pressure casting.

The invention claimed is:

1. A furniture hinge comprising a toggle hinge, and a line shock absorber having a housing, a piston rod and a pressure spring, a wing sleeve having a sleeve arranged transversely to a length of the toggle hinge, a wing and a spiral rib projecting from the sleeve, the sleeve fitted around the housing, a holder including a bearing part and a position part fixed to each other by at least one coupling element, the line shock absorber and the sleeve are within the holder, the holder is attached to the toggle hinge, the bearing part having a spacer piece separating two coaxial semi-bearings, the two coaxial semi-bearings are integral with the spacer piece and are closed at respective distal ends, each semi-bearing having an integrally formed flange, the position part having a bearing with two spaced apart supporting webs integrally formed on the bearing, the wing sleeve received by the bearing, and rotationally held within the two coaxial semi-bearings of the bearing part, the bearing of the position part having a spiral groove extending from and adjacent to only one of the two spaced apart supporting webs and engaging said spiral rib for simultaneously guiding the wing sleeve in linear and rotary movement in the bearing part, the pressure spring is configured to be compressed by movement of the wing sleeve.

2. The furniture hinge according to claim 1, wherein each of the two spaced-apart webs has a nose on a respective free end for an engagement with a respective recess on the flange of the bearing part.

3. The furniture hinge according to claim 1, wherein a longitudinal edge of the bearing has a position tooth engaging with a cut-out on the spacer piece of the bearing part when the bearing part and the position part are joined.

4. The furniture hinge according to claim 1, wherein the at least one coupling element is at least one rivet, the at least one rivet matches with holes of the spacer piece and of the bearing.

5. The furniture hinge according to claim 1, wherein the holder has the flange with a hole, which coincides with a hole in the flange of the toggle hinge.

* * * * *